US012078027B2

(12) United States Patent
Conner et al.

(10) Patent No.: US 12,078,027 B2
(45) Date of Patent: Sep. 3, 2024

(54) FRANGIBLE DISK ARRANGEMENT, METHOD, AND SYSTEM

(71) Applicant: Baker Hughes Oilfield Operations LLC, Houston, TX (US)

(72) Inventors: Nicholas S. Conner, Cypress, TX (US); Donavan Holland Brown, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/160,025

(22) Filed: Jan. 26, 2023

(65) Prior Publication Data

US 2024/0254859 A1 Aug. 1, 2024

(51) Int. Cl.
*E21B 34/06* (2006.01)
*E21B 34/08* (2006.01)

(52) U.S. Cl.
CPC ..... *E21B 34/063* (2013.01); *E21B 34/08* (2013.01)

(58) Field of Classification Search
CPC ..... E21B 34/063; E21B 34/066; E21B 34/08; E21B 33/1208; F16K 17/16
See application file for complete search history.

(56) References Cited

U.S. PATENT DOCUMENTS

| | | | | |
|---|---|---|---|---|
| 5,472,318 | A * | 12/1995 | Frank | F04B 53/06 417/63 |
| 2018/0313183 | A1* | 11/2018 | Hiorth | E21B 33/134 |
| 2019/0032448 | A1* | 1/2019 | Bjørgum | E21B 34/063 |
| 2021/0131221 | A1* | 5/2021 | Helms | E21B 17/04 |
| 2021/0230970 | A1* | 7/2021 | Yuan | E21B 43/10 |
| 2022/0251922 | A1* | 8/2022 | Hiorth | E21B 34/063 |

* cited by examiner

*Primary Examiner* — George S Gray
(74) *Attorney, Agent, or Firm* — CANTOR COLBURN LLP

(57) ABSTRACT

A frangible disk arrangement including a frangible disk disposed in a groove of a housing, and a degradable material support disposed adjacent the disk. A method for managing a borehole operation including pressuring against the frangible disk arrangement, exceeding a pressure rating of the frangible disk, rupturing the frangible disk, and degrading the support. A borehole system including a borehole in a subsurface formation, a string in the borehole, and a frangible disk arrangement disposed within or as a part of the string.

12 Claims, 5 Drawing Sheets

FRANGIBLE DISK ARRANGEMENT, METHOD, AND SYSTEM

BACKGROUND

In the resource recovery and fluid sequestration industries, there is often need for a temporary barrier that provides pressure integrity up to a known threshold pressure and thereafter to allow fluid passage. Frangible disks have been used for such duty to adequate effect, but it is a common condition of traditional arrangements that high differential pressures are not supportable in part because to the constraints associated with the need for as large a bore after rupture as possible. Disks have a significant span that has to hold pressure. This limits utility. The art would well receive alternatives that increase differential pressure capabilities without attendant drawbacks.

SUMMARY

An embodiment of a frangible disk arrangement including a frangible disk disposed in a groove of a housing, and a degradable material support disposed adjacent the disk.

An embodiment of a method for managing a borehole operation including pressuring against the frangible disk arrangement, exceeding a pressure rating of the frangible disk, rupturing the frangible disk, and degrading the support.

An embodiment of a borehole system including a borehole in a subsurface formation, a string in the borehole, and a frangible disk arrangement disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
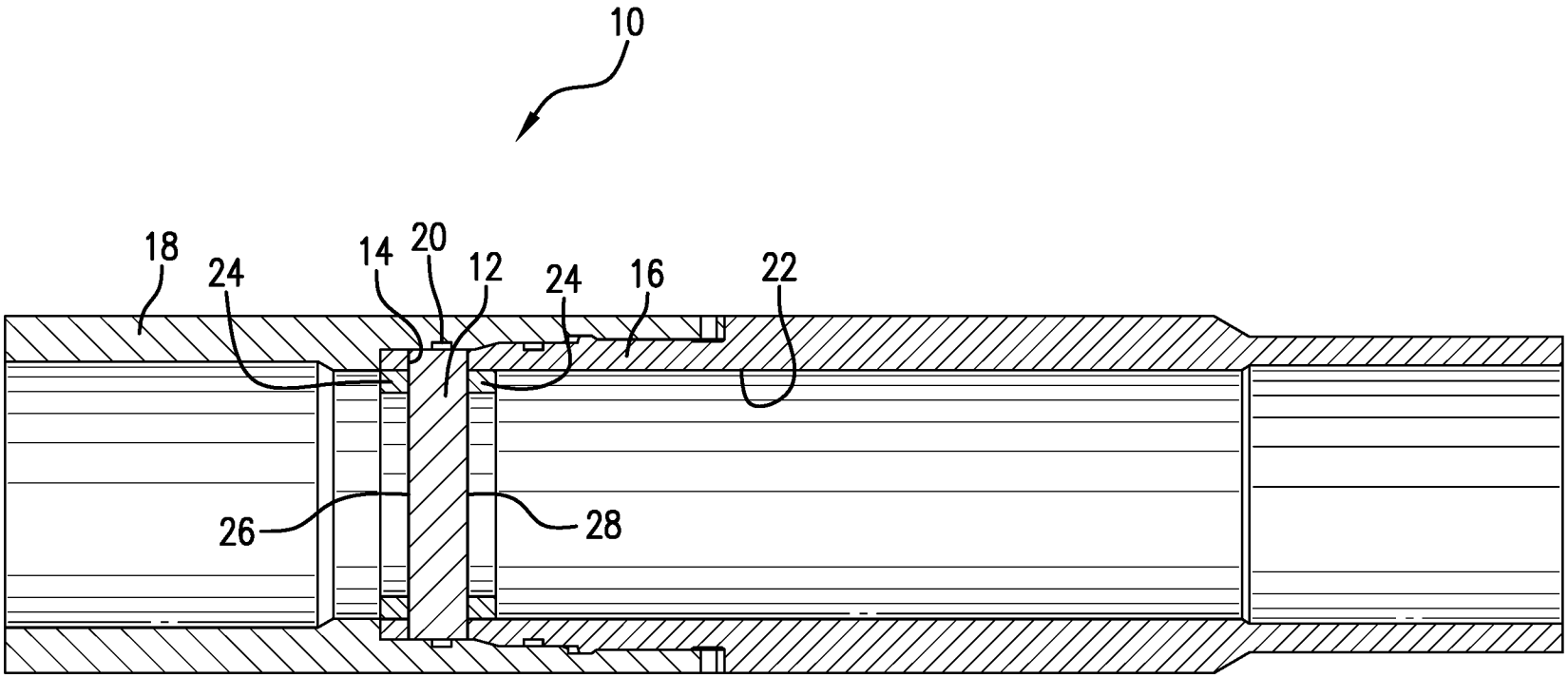
FIG. 1 is a sectional view of a frangible disk arrangement as disclosed herein.

Referring to FIG. 1, a frangible disk arrangement 10 is illustrated. The disk arrangement 10 includes a disk 12 that is supported in a groove 14 of a housing member 18. The housing 18 may be connected to another tubular 16 that together with the housing 18 and a seal 20 at the disk 12 provides for a fluid tight connection. The housing 18 and the tubular 16 define a full bore 22 therein that is sized as desired for whatever duty the housing 18 and tubular 16 (which together may form a part of a string) will serve in a borehole system. The disk 12 along with the seal 20 prevents fluid movement between the housing 18 and the tubular 16 until such fluid movement is desired by an operator. Additionally, the disk 12 is supported by one or more degradable material supports 24. As illustrated in FIG. 1, the supports 24 number two and are disposed adjacent a first major surface 26 of the disk 12 and a second major surface 28 of the disk 12.

In embodiments, the supports 24 may be rings and may cover 1-100% of a surface area of the first major surface 26 or the second major surface 28 or both (with two rings). In other embodiments, the supports 24 may be disks themselves and cover all of the first major surface 26 or second major surface 28 or both but for the amount of the disk 12 that is actually disposed in the groove 14 (as can be appreciated in FIG. 1). Regardless of the particular construction of the supports 24, they reduce a span of the disk 12 that is subjected to pressure within the tubular 16. By reducing the span, the disk 12 is better able to manage pressure without rupture and hence is suitable for higher differential pressure operations than prior art disk systems. Subsequent to rupture however, the supports 24 will go away based upon exposure to downhole fluids, flow, or both and leave a full bore 22 open for tool passage or flow requirements.

Figure 2:
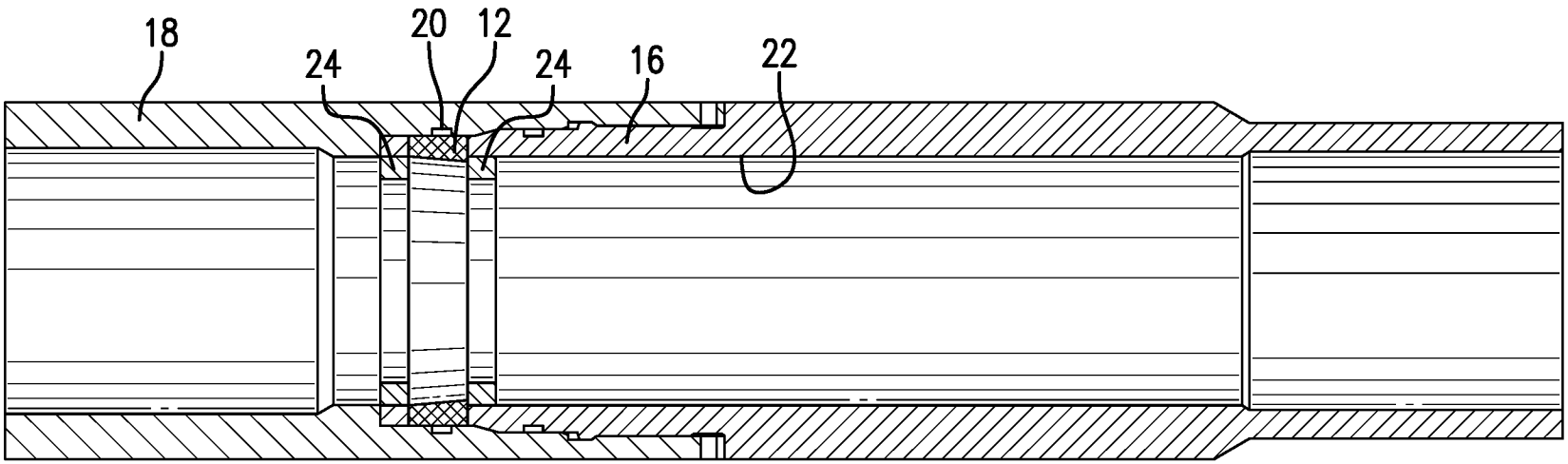
FIG. 2 is a sectional view of the arrangement of FIG. 1 after initial rupture of the disk.
Figure 3:
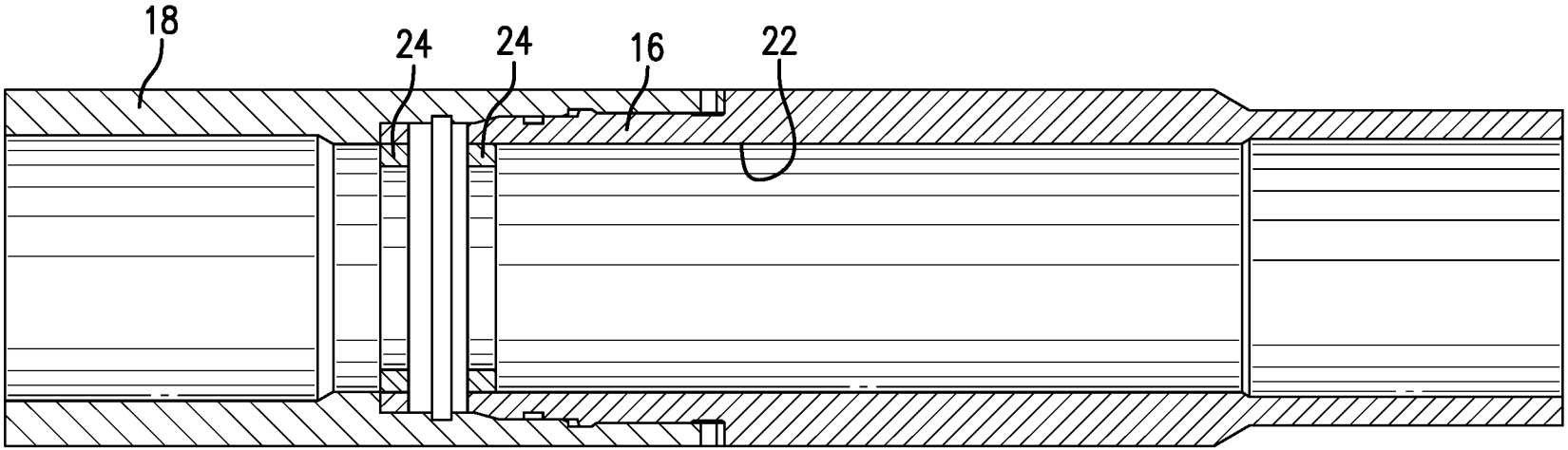
FIG. 3 is a view of the arrangement after the frangible disk is completely removed.
Figure 4:
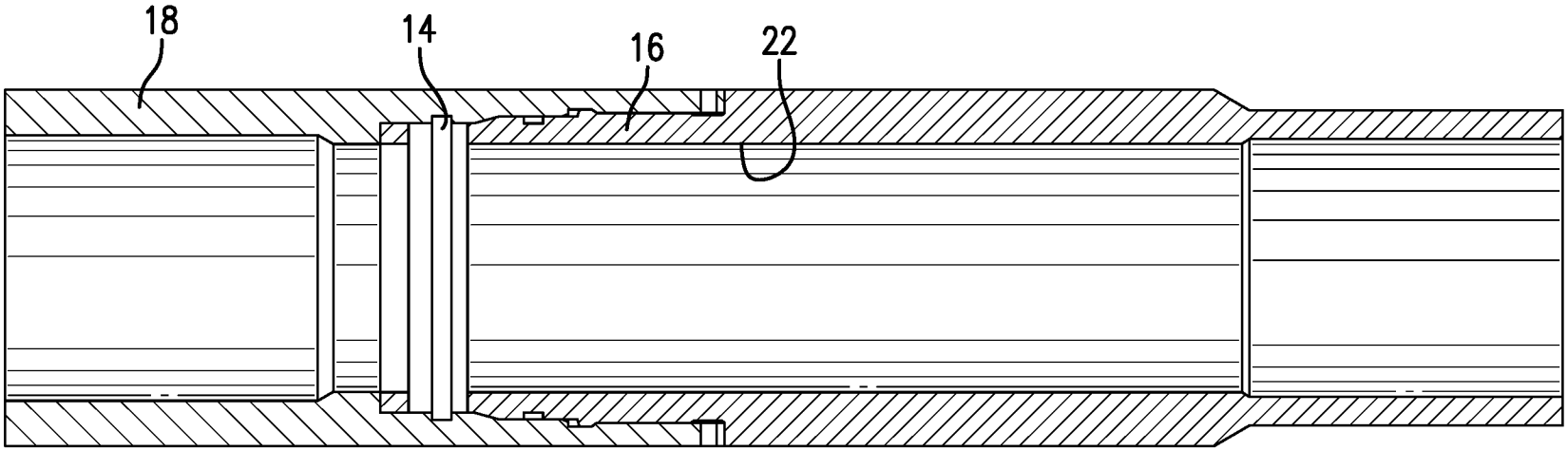
FIG. 4 is a view of the arrangement after full bore has been achieved.

In use, and referring to FIGS. 1 and 2, the arrangement 10 is run to a target location. At an appropriate and desired time, pressure is increased in housing 18 and/or tubular 16. The disk 12 ruptures due to the pressure in housing 18 exceeding a threshold pressure associated with disk 12 rupture. FIG. 2 schematically illustrates the disk 12 ruptured with fractured pieces still falling from the groove 14. It will be appreciated that the supports 24 are still intact in FIG. 2. Fluid flow is possible at this point but the full bore 22 has not yet been achieved. In FIG. 3, the rest of the disk 12 has fallen from the groove 14 leaving nothing of the disk remaining. The supports 24 are beginning to show degradation. By FIG. 4, which is a relatively short time frame from FIG. 2 of a couple of hours to a few weeks depending on the fluid and temperature exposure, the supports 24 are completely gone leaving only the full bore 22.

Figure 5:
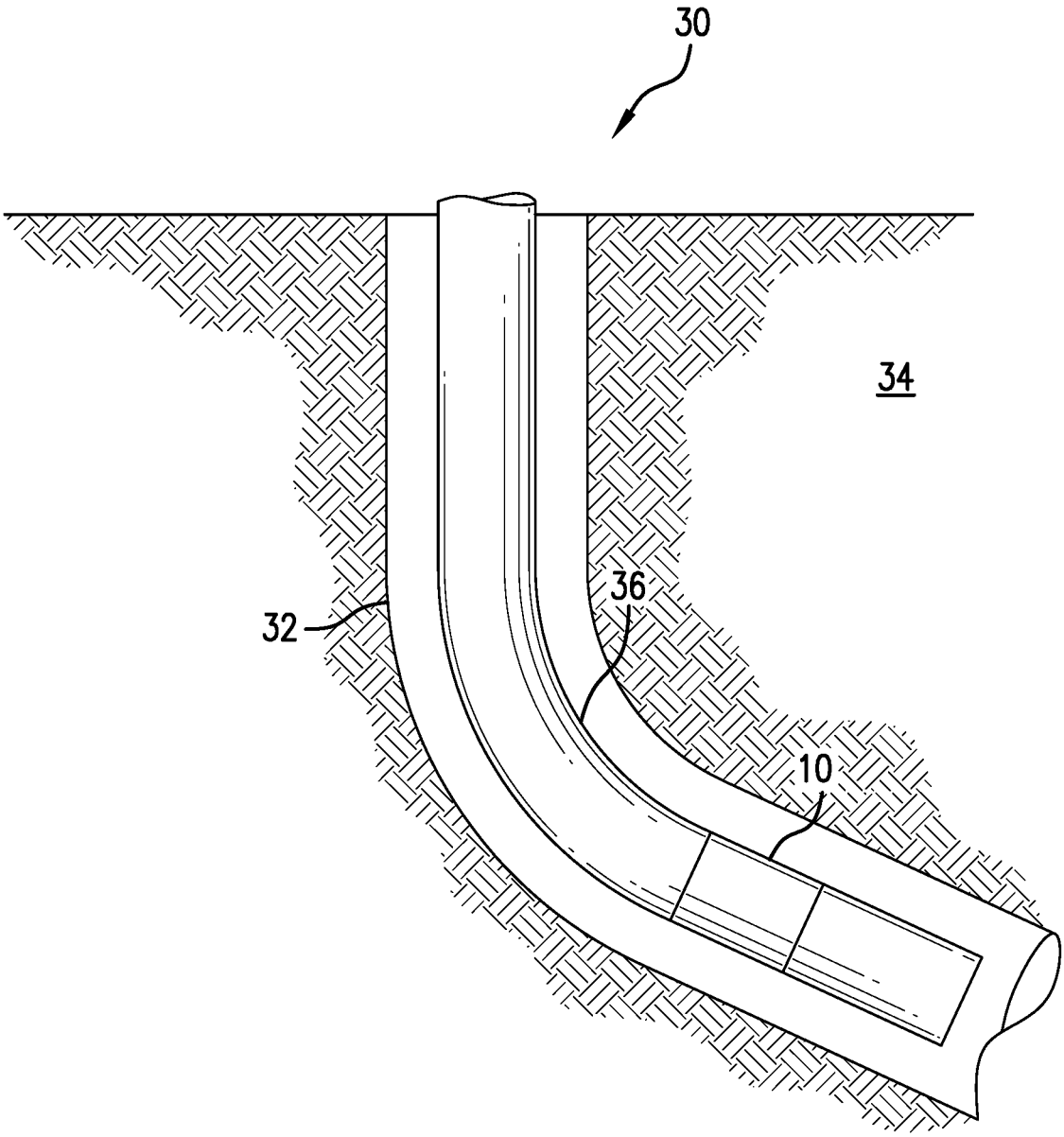
FIG. 5 is a view of a borehole system including the frangible disk arrangement as disclosed herein.

Referring to FIG. 5, a borehole system 30 is illustrated. The system 30 comprises a borehole 32 in a subsurface formation 34. A string 36 is disposed within the borehole 32. A frangible disk arrangement 10 is disposed within or as a part of the string 36.

Set forth below are some embodiments of the foregoing disclosure:

Embodiment 1: A frangible disk arrangement including a frangible disk disposed in a groove of a housing, and a degradable material support disposed adjacent the disk.

Embodiment 2: The arrangement as in any prior embodiment, wherein the support is a ring.

Embodiment 3: The arrangement as in any prior embodiment, wherein the ring covers 1-100% of a surface area of a first or a second major surface of the disk.

Embodiment 4: The arrangement as in any prior embodiment, wherein the ring covers 1-100% of a surface area of both of a first and a second major surface of the disk.

Embodiment 5: The arrangement as in any prior embodiment, wherein the ring covers different percentages of a surface area of the first major surface of the disk and of a surface area of the second major surface of the disk.

Embodiment 6: The arrangement as in any prior embodiment, wherein the support is a disk.

Embodiment 7: The arrangement as in any prior embodiment, wherein the support is disposed adjacent each of a first major surface and a second major surface of the disk.

Embodiment 8: The arrangement as in any prior embodiment, wherein the support is a corrodible electrolytic metallic material.

Embodiment 9: The arrangement as in any prior embodiment, wherein the disk includes a rupture rating and wherein the support increases a rupture rating of the arrangement above the rating of the disk.

Embodiment 10: The arrangement as in any prior embodiment, wherein the support is secured into the housing.

Embodiment 11: The arrangement as in any prior embodiment, wherein the support is interference fit into the housing.

Embodiment 12: A method for managing a borehole operation including pressuring against the frangible disk arrangement as in any prior embodiment, exceeding a pressure rating of the frangible disk, rupturing the frangible disk, and degrading the support.

Embodiment 13: The method as in any prior embodiment, wherein the degrading is by exposure to downhole fluids.

Embodiment 14: The method as in any prior embodiment, wherein the degrading is by fluids flowing past the support due to the rupture of the frangible disk.

Embodiment 15: The method as in any prior embodiment, wherein the degrading completely removes the support leaving a full bore of the housing.

Embodiment 16: A borehole system including a borehole in a subsurface formation, a string in the borehole, and a frangible disk arrangement as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frangible disk arrangement comprising:
a frangible disk disposed in a groove of a housing; and
a plurality of degradable material support rings disposed adjacent the disk, each support ring having two axial faces extending from an inside diameter of each ring to an outside diameter of each ring, the two axial faces being planar.

2. The arrangement as claimed in claim 1, wherein a first ring of the plurality of rings and a second ring of the plurality of rings cover different percentages of the surface area of the first major surface of the frangible disk and of the surface area of the second major surface of the frangible disk respectively.

3. The arrangement as claimed in claim 1, wherein the support is a corrodible electrolytic metallic material.

4. The arrangement as claimed in claim 1, wherein the frangible disk includes a rupture rating and wherein the support increases a rupture rating of the arrangement above the rating of the frangible disk.

5. The arrangement as claimed in claim 1, wherein the support is secured into the housing.

6. The arrangement as claimed in claim 1, wherein the support is interference fit into the housing.

7. A method for managing a borehole operation comprising:
pressuring against the frangible disk arrangement as claimed in claim 1;
exceeding a pressure rating of the frangible disk;
rupturing the frangible disk; and
degrading the support.

8. The method as claimed in claim 7, wherein the degrading is by exposure to downhole fluids.

9. The method as claimed in claim 7, wherein the degrading is by fluids flowing past the support due to the rupture of the frangible disk.

10. The method as claimed in claim 7, wherein the degrading completely removes the support leaving a full bore of the housing.

11. A borehole system comprising:
a borehole in a subsurface formation;
a string in the borehole; and
a frangible disk arrangement as claimed in claim 1 disposed within or as a part of the string.

12. A frangible disk arrangement comprising:
a frangible disk disposed in a groove of a housing; and
a plurality of degradable material support rings disposed adjacent the disk, wherein a first ring of the plurality of rings and a second ring of the plurality of rings cover different percentages of the surface area of the first major surface of the frangible disk and of the surface area of the second major surface of the frangible disk, respectively.

* * * * *